United States Patent [19]

Lipka et al.

[11] 4,324,042

[45] Apr. 13, 1982

[54] SHINGLE STRIPPER

[76] Inventors: Stanley H. Lipka; David J. Lipka, both of 133 Cross St., Yorkville, N.Y. 13495

[21] Appl. No.: 189,084

[22] Filed: Sep. 22, 1980

[51] Int. Cl.[3] ..... B26B 3/00

[52] U.S. Cl. ..... 30/170; 29/239; 254/131.5; 145/1 A

[58] Field of Search ..... 29/239; 30/170, 171; 254/131.5; 145/1 A

[56] References Cited

U.S. PATENT DOCUMENTS

| | | | |
|---|---|---|---|
| 752,615 | 2/1904 | Cokefair | 145/1 A |
| 1,218,145 | 3/1917 | Whittier | 145/1 A |
| 1,841,135 | 1/1932 | Lehman | 145/1 A |
| 2,714,907 | 8/1955 | Peck | 145/1 A |
| 4,009,743 | 3/1977 | Ackerman | 145/1 A |
| 4,203,210 | 5/1980 | Hadlick | 254/131.5 |

*Primary Examiner*—James L. Jones, Jr.

*Attorney, Agent, or Firm*—Bruns & Jenney

[57] ABSTRACT

Apparatus for moving under the tabs of a shingle and stripping the tabs evenly and cleanly from the underbody of the shingle along the line of joinder between the tabs and the underbody to provide a suitable subsurface over which a new roof can be laid. The apparatus involves a rectangular shaped blade that has an inclined ripping bar located upon its top surface along one side edge thereof. A tab guide is also positioned upon the top surface of the blade adjacent to its other side edge and includes a raised finger which is adapted to engage tabs passing over the blade and guide them through the apparatus. A hold down member is also mounted outboard of the blade adjacent to the ripping bar that is arranged to ride over the underbody section of the shingle to allow the stripping tool to separate the tabs without lifting the underbody of the shingle from the support sheeting to which it is nailed.

8 Claims, 4 Drawing Figures

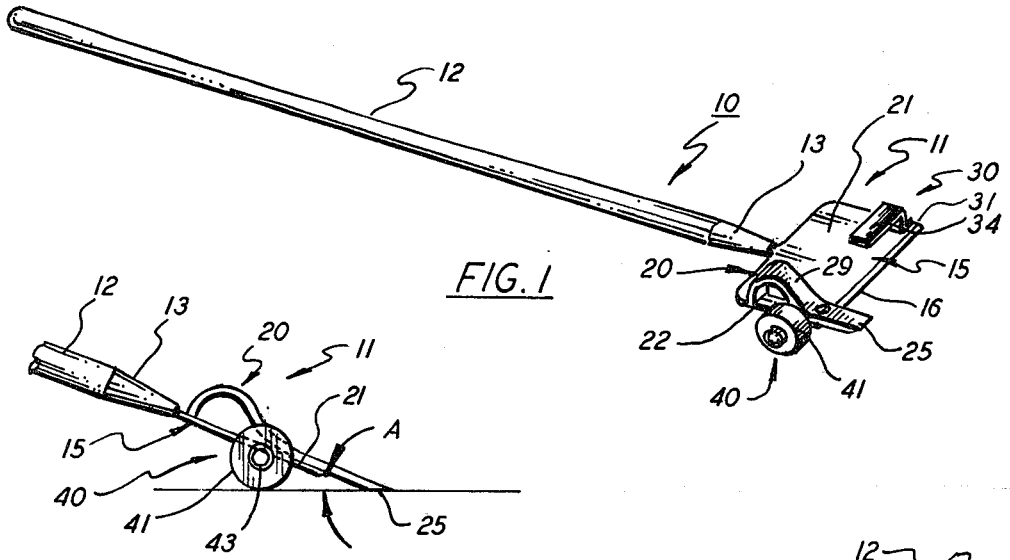
FIG. 1
FIG. 3
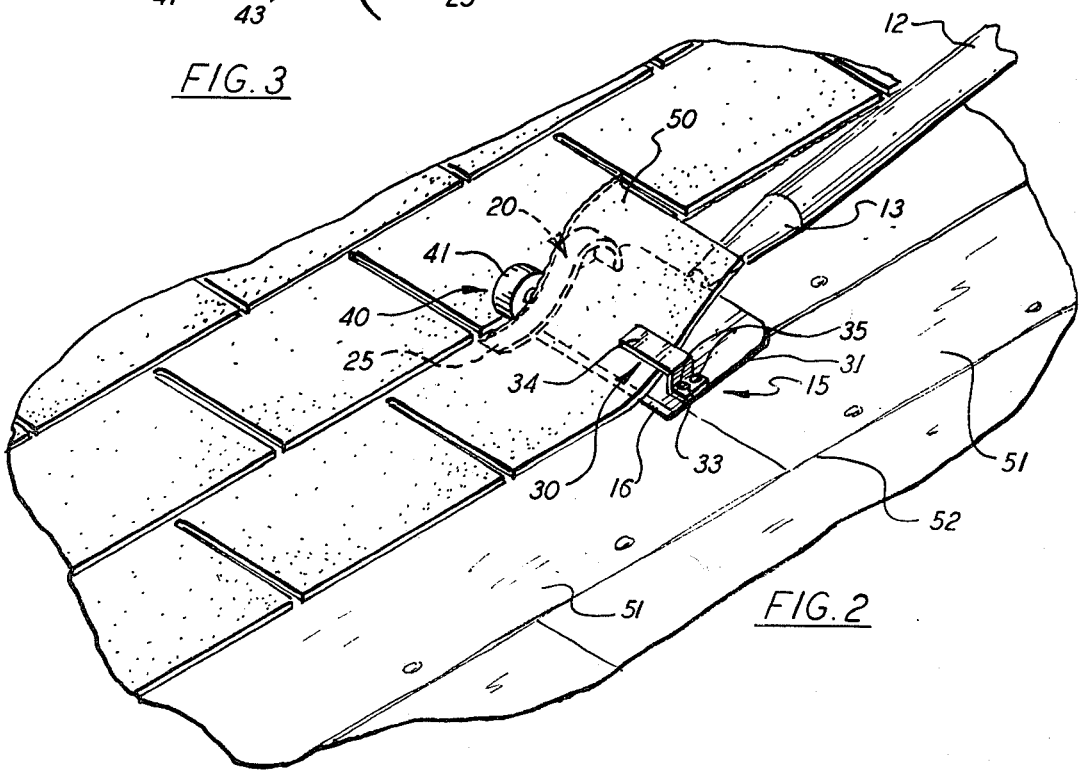
FIG. 2
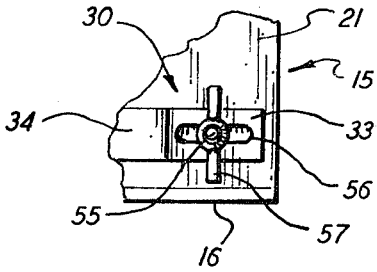
FIG. 4

SHINGLE STRIPPER

BACKGROUND OF THE INVENTION

This invention relates to apparatus for stripping the tabs from a shingle that is affixed as by nailing to a roof or wall sheeting.

Typically, when an asphalt shingle roof is to be replaced, the extended tabs on the existing shingles are stripped from the underbody section of each shingle and the new roofing laid over the remaining underbody sections. If the stripping operation can be carried out in a neat and orderly fashion, the underbody sections will form an extremely good substrate upon which to lay a new roof.

In practice, however, stripping tabs from the shingles have proven to be an extremely arduous, difficult and time consuming task. The workmen performing the stripping operation usually will use an ax or some other type of sharp cutting implement to separate the tabs from the underbody of the shingles. As a consequence, the parting line produced by the hand operation is generally uneven, rough and extremely jagged. When the new roofing is laid over this subsurface, it will have an unsightly appearance. More importantly, the rough subsurface can adversely affect the tightness of the new roofing and particularly its ability to resist weather and high winds.

It should also be noted that the use of axes and other sharp implements upon the roof can also cause damage to the underlying sheeting thereby weakening the roof structure and further roughening the substructure.

SUMMARY OF THE INVENTION

It is an object of this invention to improve apparatus for stripping shingle tabs from existing surfaces such as building roofs and the like.

A further object of the present invention is to reduce the amount of time and effort that is required to strip shingle tabs from an existing roof.

Yet another object of the present invention is to provide a well prepared subsurface upon which a replacement roof can be laid.

A still further object of the present invention is to protect the substrate of an existing structure from being damaged as the shingle tabs are stripped from the roofing or siding thereof.

Another object of the present invention is to provide a stripping bar that is capable of creating a smooth and even parting line when used to strip shingle tabs from the roofing or siding of a building.

Still another object of the present invention is to provide a stripping tool that can be easily passed beneath the shingle tabs of an existing roof to effect even and clean separation of the tabs from the shingles with a minimum amount of effort.

A still further object of the present invention is to provide for the safety of a person who is stripping shingles from a roof or the like.

These and other objects of the present invention are attained by means of a stripping tool having a flat blade, a ripping bar mounted upon the top surface of the blade along one side edge thereof which has an upwardly inclined working surface that is adapted to pass under the tabs of a shingle, a raised finger also mounted upon the top surface of the blade adjacent to the other side edge thereof that is adapted to engage and guide a shingle tab moving over the top surface of the blade and retain the tab in a predetermined position in relation to the ripping bar, and a hold down member secured to the blade and being positioned to one side thereof adjacent to the ripping bar, the member further includes a retaining surface that rides over the underbody of a shingle being stripped to prevent the underbody section from being lifted from the sheeting to which it is secured during the stripping operation.

BRIEF DESCRIPTION OF THE DRAWINGS

For a better understanding of these and other objects of the present invention, reference is had to the following detailed description of the invention which is to be read in conjunction with the accompanying drawings, wherein:

FIG. 1 is a perspective view of a stripping tool embodying the teachings of the present invention;

FIG. 2 is an enlarged perspective view showing the apparatus of the present invention stripping the tab from a shingle;

FIG. 3 is a partial side elevation of the stripping tool shown in FIG. 1 showing the angular relationship between the blade of the tool and the other related tool components; and FIG. 4 is a partial top view of the blade utilized in the present invention showing an alternative means for securing the guide finger used in the present invention to the blade so that the lateral positioning of the finger on the blade may be selectively adjusted.

DESCRIPTION OF THE INVENTION

With further reference to the drawings, the stripping tool of the present invention, which is generally referenced 10, consists of a stripping head 11 that is joined to the proximal end of an elongated handle 12 by means of a tubular connector 13. The proximal end of the handle is press fitted into the connector and may be secured in place by use of rivets or any other suitable device as is known and used in the art. Although the exact length of the handle is not important to the present invention, it is preferred that the handle be of sufficient length to enable the user to easily maneuver the stripping head in the manner to be described in greater detail below without having to bend over or assume an awkward position. This latter feature is extremely important for safety reasons when the subject tool is being used upon a steeply pitched roof on in an area where a fall could cause bodily injury. The handle can be made of any suitable material, such as wood or metal tubing.

The stripping head of the tool includes a rectangular shaped blade 15. The blade has a lateral width that is generally greater than the length of the tabs found on most standard sized shingles used for roofing or siding applications. The forward edge 16 of the blade contains a knife edge that permits the blade to easily pass beneath the shingle tabs during the stripping operation.

A ripping bar 20 is mounted upon the top surface 21 of the blade along one of the side edges thereof, which is the right-hand side edge 22 as viewed in FIG. 1. The bar can be affixed to the blade surface by any suitable means that is able to hold the bar securely to the blade during the tab separating process. In assembly, the body of the bar extends some distance in front of the forward edge 16 of the blade and terminates in a chisel edge 25 which, as in the case of the knife edge, enables the ripping bar to be easily and accurately passed under the shingle tabs. The top or working surface 29 of the ripping bar forms an inclined ramp that slopes upwardly from the top surface of the blade from the forward edge of the blade toward the rear edge thereof. The bar is adapted to force the edge of the shingle tab along the line of joinder of the tab to the underbody section of the shingle some distance above the blade as the bar moves beneath the tab.

A tab guide generally referenced 30 is also secured to the top surface of the blade adjacent to the left-hand edge 31 of the blade as viewed in FIG. 1. The tab guide, in practice, is formed from a single piece of relatively strong metal that is bent to establish a mounting flange 33 and a raised elongated finger 34 that is cantilevered from the flange. The flange is secured to the blade by screws 35—35, or any other suitable means so that the finger extends laterally from the flange towards the ripping bar. As will be explained in greater detail below, tabs passing over the ripping bar are caused to move under the finger to generate a tearing action that is capable of cleanly and evenly separating the tabs from the shingle.

A hold down member 40 is secured to the blade and is mounted adjacent to side edge 22 outboard of the ripping bar. In this particular embodiment of the invention to hold down member includes a cylindrical roller 41 that is rotatably supported from the blade by means of a shaft (not shown). The roller is secured to the shaft by a set screw 43. The lower portion of the roller is suspended below the bottom surface of the blade. When the roller and the forward edge of the blade are seated upon a flat support surface in a normal working position as shown in FIG. 3, the right-hand edge 22 of the blade will form an angle A of between 15 and 20 degrees with the support surface. The hold down member is arranged to ride over the top surface of the shingle's underbody, that is, the section of the shingle that is nailed or otherwise secured to the underlying sheeting, and prevents the underbody from being lifted from the sheeting as the tabs are being stripped. Although a roller has been described with reference to the main embodiment of the present invention, it should be clear to one skilled in the art that any suitable means whether it be rotatable or stationary, may be similarly employed in the practice of the present invention.

Turning now more specifically to FIG. 2, the stripping tool of the present invention is shown in the act of stripping a tab 50 from a roof shingle. As illustrated, the chisel edge 25 of the ripping bar has been inserted well beneath the tab and is being directed along the line of joinder between the tab and the underbody of the shingle. As the blade is moved forward, the forward edge 16 of the blade slips easily under the tab and the front edge of the shingle is directed beneath the finger of the tab guide.

With the tab situated beneath the finger, the hold down member, which is positioned opposite the finger an equal distance from the forward edge of the blade, acts upon the underbody section of the shingle adjacent to the tab. Accordingly, three separate instrumentalities are brought into play which cooperate to insure that the tab is separated evenly and cleanly from the shingle while at the same time preventing the underbody section from being lifted or torn from the support sheeting. As illustrated in FIG. 2, as the tabs are stripped from the shingles, the underbody sections 51—51 of the shingles are exposed. Because of the clean and accurate stripping action delivered by the tool, the parting line 52 created by the stripping process between rows of shingles is extremely straight and even. As a result, an extremely good subsurface is formed upon the sheeting upon which a new roof may be laid.

With further reference to FIG. 4, there is shown another embodiment of the tab guide 30 which is adjustable to permit the tool to operate upon tabs having different widths. In this embodiment, a short vertical stud 55 is welded or otherwise secured to the top surface 21 of the stripping blade. The flange 33 of the tab guide is provided with a slotted hole 56 that allows the flange to pass over the stud and be slidably positioned upon the top surface of the blade to adjust the lateral distance of the finger in relation to the ripping bar. A wing nut 57 is threaded upon the stud which, when tightened down securely, holds the flange in locking contact against the blade.

While this invention has been described with reference to the details as set forth above, it is not limited to the specific structure as disclosed and the invention is intended to cover any modifications or changes as may come within the scope of the following claims.

We claim:

1. Apparatus for stripping the tabs from the underbody of a shingle that has been nailed to a subsurface including a blade having a top surface and a bottom surface that are cojoined to form a thin forward edge which is able to pass easily under the tabs of a shingle, a ripping bar mounted upon the top surface of the blade along one edge thereof, said ripping bar having a ramp section that slopes upwardly from the forward edge of the blade toward the rear edge thereof, a tab guide having a support flange secured to the top surface of the blade adjacent to the other side edge thereof and a raised finger canterlevered from the flange which extends over the top surface of the blade from the flange toward the ripping bar whereby the tab of a shingle passing over the top surface of the blade is caused to pass under the finger, and a hold down member secured to the blade and extending outwardly from said one side edge thereof adjacent to the ripping bar, said hold down member further having a working surface that extends downwardly below the bottom surface of the blade to ride over the underbody of the shingle as the ripping bar passes under the tabs whereby the tabs are separated from the underbody of the shingle.

2. The apparatus of claim 1 that further includes an elongated handle attached to the rear edge of the blade.

3. The apparatus of claim 1 wherein said hold down member is a roller that is rotatably supported from the blade by means of a shaft.

4. The apparatus of claim 1 wherein said tab guide further includes an adjusting means operatively associated with the support flange for permitting laterally repositioning of said tab guide upon the top surface of the blade whereby tabs of varying widths can be passed over the blade.

5. The apparatus of claim 1 wherein said blade is generally rectangular shaped.

6. The apparatus of claim 1 wherein the plane described by the bottom surface of the hold down member and the knife edge of the blade forms an angle of between 15° and 20° with the said one side edge of the blade.

7. The apparatus of claim 1 wherein the ripping bar extends outwardly beyond the forward edge of the blade and terminates in a chisel edge.

8. The apparatus of claim 1 wherein the finger of the tab guide and the working surface of the hold down member are both located at about the same distance back from the forward edge of the blade.

* * * * *